US005471842A

United States Patent [19]

Mostello et al.

[11] Patent Number: 5,471,842

[45] Date of Patent: Dec. 5, 1995

[54] CRYOGENIC RECTIFICATION METHOD AND APPARATUS

[75] Inventors: Robert A. Mostello, Somerville; Sidney S. Stern, Highland Park, both of N.J.

[73] Assignee: The BOC Group, Inc., New Providence, N.J.

[21] Appl. No.: 292,126

[22] Filed: Aug. 17, 1994

[51] Int. Cl.[6] ..... F25J 3/02

[52] U.S. Cl. ..... 62/24; 62/41

[58] Field of Search ..... 62/24, 39, 41

[56] References Cited

U.S. PATENT DOCUMENTS

| | | | |
|---|---|---|---|
| 3,500,651 | 3/1970 | Becker | 62/41 |
| 3,754,406 | 8/1973 | Allam | 62/41 |
| 4,308,043 | 12/1981 | Yearout | 62/13 |
| 4,417,449 | 11/1983 | Hegarty et al. | 62/28 |
| 4,595,405 | 6/1986 | Agrawal et al. | 62/18 |
| 4,602,477 | 7/1986 | Lucadamo | 62/24 |
| 4,778,498 | 10/1988 | Hanson et al. | 62/41 |

*Primary Examiner*—Ronald C. Capossela
*Attorney, Agent, or Firm*—David M. Rosenblum; Larry R. Cassett

[57] ABSTRACT

A cryogenic rectification method for producing a product stream from a gaseous mixture having higher and lower volatility components and heavy impurities. In accordance with the method, the mixture is separated by a cryogenic rectification process employing one or more columns having plates, trays or packing for intimately contacting ascending vapor and descending liquid streams within the column. The mixture to be separated after having been compressed is combined with the recycle stream to produce a combined stream which is purified in a prepurification unit that is designed to remove the heavy contaminants. The combined steam is divided into major and minor streams. The major stream is then cooled and separated into liquid and vapor phases. Heavy impurities concentrate in the liquid phase taken as the recycle stream, which is then pumped to a high enough pressure for vaporization of the impurities. The resulting vapor is then reduced in pressure and combined with the incoming gaseous mixture. The concentration of heavy impurities in the vapor phase is reduced to a sufficient extent such that a product stream concentrated in the lower volatility component will have a reduction in its heavy impurity concentration. The product stream is pumped to pressure and vaporized against a portion of mixture using a boosted pressure subsidiary stream made up of a minor portion of the gaseous mixture.

14 Claims, 1 Drawing Sheet

CRYOGENIC RECTIFICATION METHOD AND APPARATUS

BACKGROUND OF THE INVENTION

The present invention relates to a cryogenic rectification method and apparatus for separating a mixture into lower and higher volatility components with a reduced concentration of impurities in the lower volatility component. More particularly the present invention relates to such a method and apparatus as applied to the separation of air to produce a pumped liquid oxygen product having a reduced concentration of such heavy impurities as carbon dioxide and flammable hydrocarbons.

Mixtures are separated into their higher and lower volatility components by cryogenic rectification which is generally carried out in rectification columns having trays or packings. The separation is characterized by a countercurrent vapor-liquid contact of a descending liquid phase with an ascending vapor phase on the trays or within the packing. The descending liquid phase becomes ever more concentrated in the lower volatility components as it descends within the rectification column and the ascending vapor phase becomes ever more concentrated with the higher volatility components as it ascends within the rectification column. Heavy impurities concentrate within the descending liquid phase. In case of cryogenic air separations, heavy impurities such as carbon dioxide can present problems in carrying out the separation in the first instance.

As an example, in cryogenic air separation plants that produce gaseous oxygen at a delivery pressure by vaporizing pumped liquid oxygen in a main heat exchanger, heavy impurities such as carbon dioxide and hydrocarbons can exceed their solubility limit in the liquid oxygen as it vaporizes. As a result, carbon dioxide contained within the liquid oxygen can solidify to thereby plug up the heat exchange passageways within the main heat exchanger and hydrocarbons such as acetylene can come out of solution to present a safety hazard.

Generally speaking in case of liquid oxygen production, the heavy impurities are removed from the incoming air by an adsorptive prepurification unit. Some impurities, however, remain, and as a result, heavy impurities will concentrate within the lower volatility component of air, namely oxygen.

As will be discussed, the present invention provides a method to increase heavy impurity removal at the front end of the plant so that the volatile component to be separated has a reduced concentration of the heavy impurities.

SUMMARY OF THE INVENTION

The present invention provides a method and apparatus for separating a gaseous mixture comprising higher and lower volatility components and heavy impurities to obtain a product stream predominantly containing the lower volatility components of the gaseous mixture. In accordance with the method, the gaseous mixture is subjected to a cryogenic rectification process to produce the product stream. The cryogenic rectification process has compression, cooling and distillation stages and a prepurification stage located between the compression and cooling stages. A recycle stream is formed from a liquid concentrated in the heavy impurities. The recycle stream is pumped to a sufficient pressure that the heavy impurities will vaporize with the liquid. The recycle stream is vaporized and then pressure reduced to a pressure about equal to that of the gaseous mixture between the compression and prepurification stages and is then combined with the gaseous mixture to be separated. This combination forms a combined stream which is introduced into the prepurification stage. At least a major portion of the combined stream is introduced into the cooling stage and after the at least a major portion of the combined stream is cooled, heavy impurities contained within the at least a major portion of the combined stream are concentrated in the liquid used in forming the recycle stream so that a vapor is formed lean in the heavy impurities. The vapor is introduced into the distillation stage to produce the product stream. The result of this is that the product stream will have a reduced concentration of the heavy impurities below a concentration that would otherwise have been obtained had the heavy impurities not been concentrated within the liquid.

The apparatus comprises a cryogenic rectification means for producing the product stream. The cryogenic rectification means has compression, cooling and distillation stages and a prepurification stage located between the compression and cooling stages. The cryogenic rectification means also has a pump for pumping a recycle stream formed from a liquid concentrated in the heavy impurities to a sufficient pressure that the heavy impurities will vaporize with the liquid. The pump is connected to the cooling stage so that the recycle stream vaporizes within the cooling stage. A pressure reduction valve is in communication with the cooling stage and the prepurification stage so that the recycle stream combines with the gaseous mixture to be separated to form a combined stream flowing through the prepurification stage. A cooling stage is connected to the prepurification stage so that at least a major part of the combined stream flows through the cooling stage. A means is connected to the cooling stage and the distillation stage for concentrating the heavy impurities contained within the at least major part of the combined stream in a liquid so that the recycle stream and a vapor lean in the heavy impurities are formed. Moreover, the connection allows the vapor to flow into the distillation stage to produce the product stream. As a result, the product stream will have a reduced concentration of the heavy impurities below a concentration that would otherwise have been attained had heavy impurities not been concentrated within the liquid.

The present invention has application to any process and any plant configuration in which a product stream predominantly containing lower volatility components of the gaseous mixture to be separated is to be obtained. In case of air separation, the present invention could be said to be applicable to any plant that has an oxygen product. Thus, the present invention would find use in a plant in which the distillation stage was a single column oxygen generator. The present invention, though, would have more common application to the familiar double column plant in which liquid oxygen is produced as a column bottom in a lower pressure column. The present invention would have general application to pumped liquid oxygen plants in which the liquid oxygen is pumped to a high pressure and then vaporized within a main heat exchanger against a minor part of the incoming air stream that is boosted in pressure. In such a plant, given the delivery pressures of the oxygen product, the heavy impurities will tend to remain after the liquid oxygen vaporizes. As mentioned above, heavy impurities as carbon dioxide can freeze to obstruct heat exchange passages within the main heat exchanger and the hydrocarbons can present an explosion hazard. By substantially reducing the level of the heavy impurities, these foregoing problems can be alleviated in the operation of an air separation plant designed to produce a high pressure oxygen product.

BRIEF DESCRIPTION OF THE DRAWINGS

While the specification concludes with claims distinctly pointing out the subject matter that applicants regard as their invention, it is believed that the invention will be better understood when taken in connection with the accompanying drawings in which:

DETAILED DESCRIPTION

Figures 1, 2:
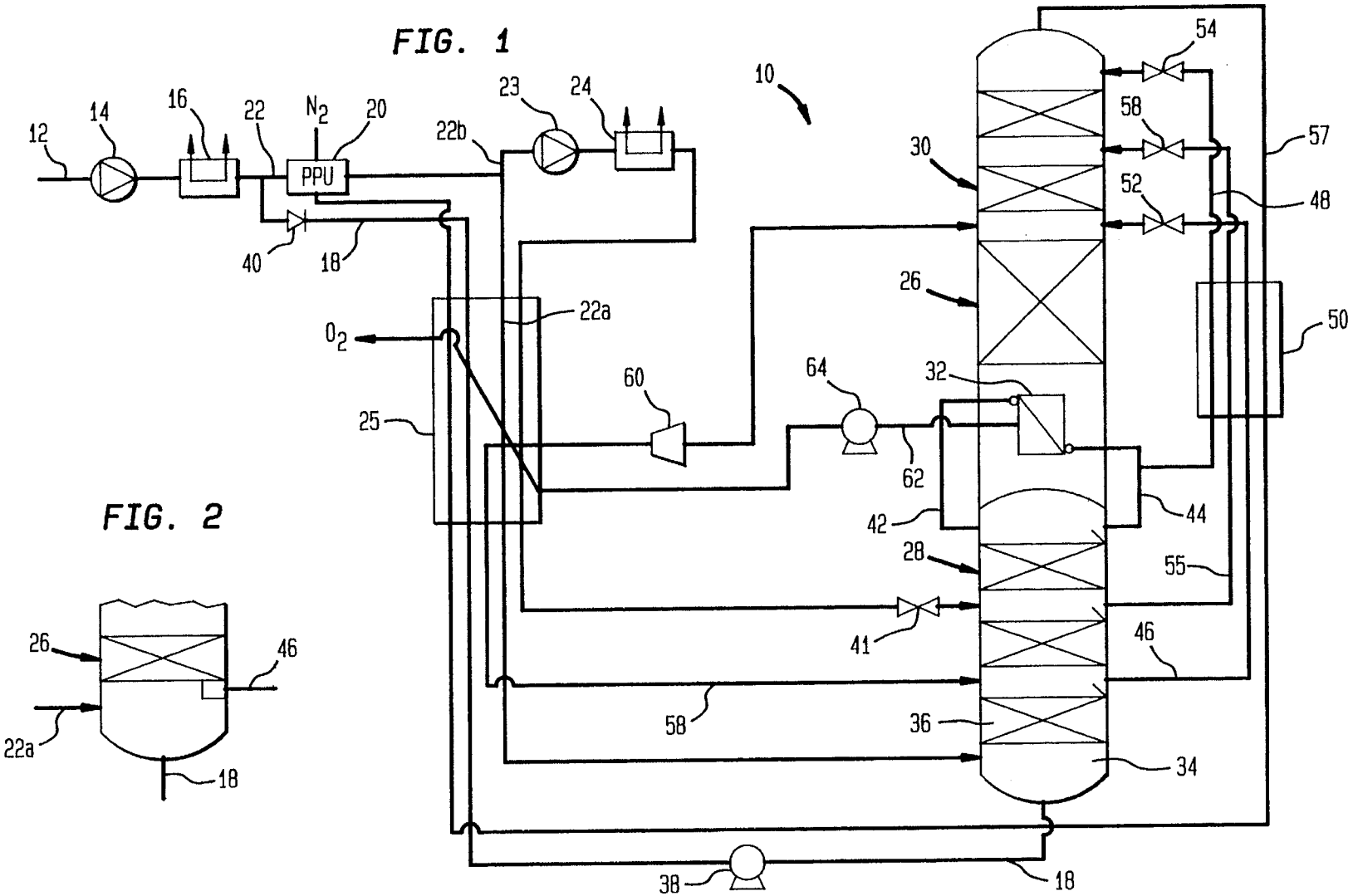
FIG. 1 is a schematic representation of an apparatus for carrying out a method in accordance with the present invention.
FIG. 2 is a fragmentary view of alternative embodiment of FIG. 1.

With reference to FIG. 1, an apparatus 10 in accordance with the present invention is illustrated for carrying out a method in accordance with the present invention. Apparatus 10 is specifically designed to produce a high pressure oxygen product. However, the present invention is not limited to producing high pressure oxygen products nor is it limited to the rectification of air. The present invention does concern cryogenic rectification in which compression and cooling stages are used to compress and cool a gaseous mixture so that the gaseous mixture can be separated in a distillation stage into higher and lower volatility components of the gaseous mixture. Heavy impurities are substantially removed from the gaseous mixture in a prepurification stage, but, as mentioned above, some heavy impurity content remains in the gaseous mixture.

In apparatus 10 an air stream 12 after having been filtered to remove dust particles an the like, is subjected to a compression stage including a compressor 14 and an aftercooler 16 to remove the heat of compression. Air stream 12 is then combined with a recycle stream 18 and is purified in a prepurification stage consisting of a prepurification unit 20 of the type designed to remove water and carbon dioxide from air stream 12. Prepurification unit 20 can consist of adsorbent beds operating out of phase from one another for regeneration purposes.

Recycle stream 18 and air stream 12 make up a combined stream 22 to be purified within prepurification unit 20. A booster compression stage, comprising a booster compressor 23 and an aftercooler 24, is connected to prepurification unit 20 so that combined stream 22 is divided into major and minor portions, designated as major and minor subsidiary streams **22*a* and 22*b* . The use of a booster compressor in such a manner, well known in the art, allows the vaporization of the high pressure product stream within a cooling stage formed by a main heat exchanger 25. Against such vaporization, minor subsidiary stream 22*b* cools within main heat exchanger 25 to a temperature suitable for its rectification. This temperature is normally at or near the bubble point temperature of air. As is well known in the art the pressure of minor subsidiary stream 22*b* must be sufficiently boosted in pressure to serve in the requisite vaporization duty. The major subsidiary stream 22*a*** is cooled to about the air dew point temperature.

An air separation unit 26, which serves as the distillation stage of apparatus 10, has a higher pressure column 28 and a lower pressure column 30. Columns 28 and 30 are in a heat exchange relationship by provision of a condenser reboiler 32 which will be discussed hereinafter. Columns 28 and 30 have liquid/vapor contact elements such as random or structured packing, sieve plates, bubble cap trays and etc. These contact elements are used to bring descending liquid and the ascending vapor phases of the mixture into intimate contact with one another. As the vapor rises within each column, from tray to tray or through packing, it becomes ever more concentrated in the more volatile components of air, e.g. nitrogen. As the liquid descends within the column, it becomes more concentrated in the less volatile components of the mixture to be separated, in case of air, oxygen. The descending liquid also becomes more concentrated in the heavy components. Therefore, the heavy components of air, carbon dioxide and hydrocarbons, will concentrate in the oxygen product.

Higher pressure column 28 has an extended bottom portion 34 containing liquid-vapor contact elements illustrated by reference numeral 36 (trays or packing). Incoming major subsidiary stream **22*a* is introduced into extended bottom portion 34 as a vapor which is scrubbed of heavy impurities by descending liquid to concentrate the heavy impurities in the liquid at the very bottom of extended bottom portion 34. All of the liquid concentrated in the heavy impurities is removed as recycle stream 18. Recycle stream 18 is then pumped by a pump 38 to a pressure sufficient that when recycle stream 18 is vaporized within main heat exchanger 25, the heavy impurities will vaporize with the other components of the liquid collected in extended bottom portion 34. Recycle stream 18 is then reduced in pressure by a pressure reduction valve 40 to the pressure of air stream 12 (after compression by compressor 14) so that recycle stream 18 can be combined with air stream 12**.

As can be appreciated, prepurification unit 20 is thereby continually removing not only the heavy impurities of incoming air steam 12 but also concentrated impurities within the liquid phase collected within extended bottom portion 34 of higher pressure column 28. At the same time, since the heavy impurities concentrate within the liquid phase, the vapor phase will have a concentration of the heavy impurities that is far lower than the heavy impurity concentration of the air. It is the vapor phase which will be rectified and as such, the level of heavy impurities can be reduced so that even those such heavy impurities which eventually concentrate in the lower volatility component of air, namely oxygen, will concentrate at low concentration levels, to reduce impurity levels within the oxygen product.

Minor subsidiary stream **22*b* is also introduced into higher pressure column 28 by a pressure reduction valve 41 and introduced into higher pressure column 28 at an intermediate location thereof. Although minor subsidiary stream 22*b* is not subjected to scrubbing, it has a lower flow rate than major subsidiary stream 22*a*. Hence, the reduction of heavy impurity concentration levels of major subsidiary stream 22*a*** predominate to lower overall heavy contaminant concentrations within the liquid oxygen.

Air separation unit 26 is a double column unit functioning in a conventional manner. The vapor phase rising in column 28 becomes ever more concentrated in nitrogen. Nitrogen tower overhead stream 42 (comprising a nitrogen rich fraction of the air) is removed from the top of higher pressure column 28 and is then condensed by condenser reboiler 32. A first reflux stream 44 is returned to higher pressure column 28 so that a descending liquid phase is thereby initiated which becomes ever more concentrated in liquid oxygen to form an oxygen-rich fraction of the air. The descending liquid is collected and removed from higher pressure column 28 as a rich liquid stream 46. As illustrated, rich liquid stream 46 is removed at a level of higher pressure column 28 located above liquid vapor contacting elements 36. As such rich liquid stream 46 is not allowed to co-mingle with the liquid phase collected within extended bottom portion 34 of higher pressure column 28. A second reflux stream 48 is also extracted from the condensed nitrogen tower overhead stream 42. Rich liquid stream 46 and second reflux stream 48 are subcooled in a subcooler 50, reduced in pressure to lower pressure column 30 by pressure reduction valves 52 and 54, and are then introduced into lower pressure column 30. In order to mass balance higher pressure column 28, reflux stream 55 is removed, subcooled within subcooler 50, pressure reduced by pressure reduction valve 56, and introduced into lower pressure column 30.

In lower pressure column 30, the liquid phase descends and becomes ever more concentrated in oxygen so as to collect as a liquid oxygen fraction of the air in the bottom of lower pressure column 30. The collected liquid oxygen is vaporized by the nitrogen-rich vapor used in forming nitrogen tower overhead stream 42 passing through condenser-reboiler 32.

A waste nitrogen stream 57 formed from the nitrogen fraction of the air passes through subcooler 50 to subcool second reflux stream 48, rich liquid stream 46 and reflux stream 55. This causes a partial warming of waste nitrogen stream 57. Waste nitrogen stream 57 is then fully warmed within main heat exchanger 25 where it serves to also help reduce the temperature of incoming major and minor subsidiary streams **22*a* and 22*b*. At least a part of waste nitrogen stream 20 also serves to regenerate prepurification unit 20. In order to balance cold box heat leakage and warm-end heat content differences of apparatus 10, a refrigerant stream 58 is extracted from the higher pressure column 28 and partially warmed within main heat exchanger 25. After turboexpansion within turboexpander 60, the refrigerant stream 58 is introduced into lower pressure column 30**.

An oxygen product stream 62 is removed from the bottom of lower pressure column 30 where it is pumped by pump 64 to the requisite high pressure. Product oxygen stream 62 is then vaporized within main heat exchanger 25. Remaining impurities have concentrated within oxygen product stream 62 and they will vaporize with the oxygen.

With reference to FIG. 2, extended bottom portion 34 can be devoid of liquid-vapor contact elements 36 and instead serve to phase separate the major portion of combined stream 22 (major subsidiary stream **22*a* ). In such case, major subsidiary stream 22*a* is partially cooled within main heat exchanger 25 so that it has liquid and vapor phases which can be separated within extended bottom portion 34. The heavy impurities will concentrate in the liquid phase and collect at the very bottom of extended bottom portion 34 of higher pressure column 28. The vapor phase, lean in heavy impurities, will be subjected to the distillation. In the illustration, rich liquid stream 46 is removed from the lowermost tray 66 to prevent co-mingling of the liquid phase to be further refined within lower pressure column 30 and the liquid collected within extended bottom portion 34. As can be appreciated, although higher pressure column 30** is provided with a trayless bottom portion, a separate phase separator could be used and attached to a conventional column.

The following is a calculated example showing the operation of apparatus of FIG. 1. In the example carbon dioxide is the contaminant. However, it is applicable to any contaminant which may separate from the boiling product oxygen as a pure contaminant phase or contaminant-rich phase.

Prepurification unit 20 in air separation plant 10 removes 99.98 of the carbon dioxide that enters the unit. Incoming air stream 12 contains 350 vpm (pans per million on a molar basis) carbon dioxide. The partially purified air contains 0.07 vpm carbon dioxide, which normally collects in the liquid oxygen withdrawn from the lower pressure column 30 where it will normally contain about 0.32 vpm carbon dioxide. The product oxygen is required at 3.0 bara, which requires a boosted air pressure of about 8.6 bara. However, with about 0.32 vpm carbon dioxide content, the liquid oxygen must be pressurized to about 4.5 bara to avoid phase separation of carbon dioxide during vaporization in the main heat exchanger. Such a vaporization pressure would require a boosted air pressure of about 11 bara, an extra and unnecessary expenditure of energy.

In keeping with the invention, air which enters the higher pressure column 28 as vapor is scrubbed with a small amount of liquid within liquid-vapor contacting elements 36 (FIG. 1) to clean it of carbon dioxide or alternatively partially condensed forming a liquid containing most of the carbon dioxide (FIG. 2). The liquid oxygen withdrawn from the low pressure column will now contain 0.093 vpm of carbon dioxide, suitable for a 3.1 bara vaporization pressure. Recycle stream 18 containing about 2.5 vpm of carbon dioxide, is pumped to a suitable high pressure of about 17 bara to prevent precipitation of carbon dioxide. A boosted air pressure of about 8.6 bara is adequate to effect the heat transfer for the vaporization of the liquid oxygen and the scrubber bottoms. Refrigeration of recycle stream 18 is recovered in main heat exchanger 25 and its pressure is partially recovered with its oxygen content by adding the recycle stream to the air stream 12 upstream of prepurification unit 20.

In more detail, air stream 12 at a flow rate of 1000 $Nm^3/hr$ is compressed to about 5.5 bara, cooled and passed to prepurification unit 20. About 322 $Nm^3/hr$ of air leaving prepurification unit 20 as minor subsidiary stream **22*b* is further compressed to about 8.6 bara. Both major and minor subsidiary streams 22*a* and 22*b* are cooled in the main heat exchanger where the major subsidiary stream 22*a* exits close to its dew point and the minor subsidiary stream 22*b*** exits mostly liquefied.

Major subsidiary stream **22*a* is scrubbed of its carbon dioxide content by about 20 $Nm^3/hr$ of liquid in lower section 34 of the higher pressure column. The scrubber bottoms containing about 40% oxygen is extracted as recycle stream 18 which is pumped to about 17 bara and passed through main heat exchanger 25. When recycle stream 18 emerges, it is throttled into air stream 12 upstream of the prepurification unit 20 to form combined stream 22**.

The process is a normal double column process with turboexpansion of a stream to produce refrigeration. About 220 $Nm^3/hr$ of a liquid oxygen product containing 95% oxygen is withdrawn and pumped to 3.1 bara, passed to the main heat exchanger where it is vaporized and heated and delivered as about a 3 bara product. Waste nitrogen stream 57 from the top of lower pressure column 30 passes through a liquids subcooler 50 and then is warmed in the main heat exchanger. Part of this gas may be heated and used for regeneration of the prepurification dual bed unit.

Although the present invention has been discussed with reference to preferred embodiments, it will be understood by those skilled in the art that numerous changes, omissions, and additions may be made in such preferred embodiments without departing from the spirit and scope of the present invention.

We claim:

1. A method of separating a gaseous mixture comprising higher and lower volatility components and heavy impurities to obtain a product stream predominantly containing said lower volatility components of said gaseous mixture, said method comprising:

subjecting said gaseous mixture to a cryogenic rectification process to produce said product stream, said cryogenic rectification process having compression, cooling and distillation stages and a prepurification stage located between said compression and cooling stages;

forming a recycle stream from a liquid concentrated in said heavy impurities;

pumping said recycle stream to a sufficient pressure that said heavy impurities will vaporize with said liquid;

vaporizing and then pressure reducing said recycle stream to a pressure about equal to that of said gaseous mixture between said compression and prepurification stages;

combining said recycle stream with said gaseous mixture to be separated to form a combined stream and then, introducing said combined stream into said prepurification stage;

introducing at least a major part of said combined stream into said cooling stage and after said at least a major part of said combined stream is cooled, concentrating said heavy impurities contained within said at least a major part of said combined stream into said liquid used in forming said recycle stream so that a vapor is formed lean in said heavy impurities;

introducing said vapor into said distillation stage to produce said product stream, whereby said product stream will have a reduced concentration of said heavy impurities below a concentration that would otherwise have been obtained had said heavy impurities been not concentrated within said liquid.

2. The method of claim 1 wherein said heavy impurities are concentrated within said liquid by:

partially cooling said at least major part of said combined stream so that said at least major part of said combined stream comprises said liquid and said vapor between said cooling and distillation stages; and separating said vapor and said liquid., 3. The method of claim 2, wherein:

said cryogenic rectification process is conducted so that said product stream is initially a liquid product stream; and said method further comprises:

pumping said liquid product stream to an elevated pressure;

vaporizing said liquid product stream within said cooling stage to produce said product stream at said elevated pressure;

dividing said combined stream into major and minor subsidiary streams so that said at least a major part of said combined stream is formed from said major subsidiary stream;

subjecting said minor subsidiary stream to a booster compression stage so that said minor subsidiary stream has a boosted pressure;

introducing said minor subsidiary stream into said cooling stage in a direction countercurrent to that of said liquid product stream; and introducing said minor subsidiary stream after said cooling stage into said distillation stage.

4. The method of claim 1, wherein said heavy impurities are concentrated within said liquid by scrubbing said at least a major part of said combined stream with a descending liquid formed from a descending liquid phase within said distillation stage.

5. The method of claim 4, wherein:

said cryogenic rectification process is conducted so that said product stream is initially a liquid product stream; and said method further comprises:

pumping said liquid product stream to an elevated pressure;

vaporizing said liquid product stream within said cooling stage to produce said product stream at said elevated pressure;

dividing said combined stream into major and minor subsidiary streams so that said at least a major part of said combined stream is formed from said major subsidiary stream;

subjecting said minor subsidiary stream to a booster compression stage so that said minor subsidiary stream has a boosted pressure;

introducing said minor subsidiary stream into said cooling stage in a direction countercurrent to that of said liquid product stream; and introducing said minor subsidiary stream after said cooling stage into said distillation stage.

6. The method of claim 3 or claim 5, wherein:

said gaseous mixture comprises air and said higher and lower volatility components comprise nitrogen and oxygen, respectively, and said heavy impurities include carbon dioxide and hydrocarbons;

said distillation stage comprises a double column air separation unit having a higher pressure column connected to a lower pressure column in a heat transfer relationship;

said vapor and said minor subsidiary stream are introduced into said double column air separation unit so that the air is refined within said higher pressure column into oxygen-rich and nitrogen-rich fractions and an oxygen rich stream composed of said oxygen-rich fraction is introduced into said lower pressure column for further refinement, thereby to produce a liquid oxygen fraction and a nitrogen fraction; and said liquid product stream is removed from said lower pressure column and comprises said liquid oxygen fraction.

7. An apparatus for separating a gaseous mixture comprising higher and lower volatility components and heavy impurities to obtain a product stream predominantly containing said lower volatility components of said gaseous mixture, said apparatus comprising:

cryogenic rectification means for producing said product stream, said cryogenic rectification means having compression, cooling and distillation stages and a prepurification stage located between said compression and cooling stages;

said cryogenic rectification means also having, a pump for pumping a recycle stream formed from a liquid concentrated in said heavy impurities to a sufficient pressure that said heavy impurities will vaporize with said liquid;

said pump connected to said cooling stage so that said recycle stream vaporizes within said cooling stage;

a pressure reduction valve in communication with said cooling stage and said prepurification stage so that said recycle stream combines with said gaseous mixture to be separated to form a combined stream flowing through said prepurification stage;

said cooling stage connected to said prepurification stage so that at least a major part of said combined stream flows through said cooling stage; and means connected to said cooling stage and said distillation stage for concentrating said heavy impurities contained within said combined stream in said liquid so that said recycle stream and a vapor lean in said heavy impurities are formed and said vapor flows into said distillation stage to produce said product stream, whereby said product stream will have a reduced concentration of said heavy impurities below a concentration that would otherwise have been obtained had said heavy impurities not been concentrated within said liquid.

8. The apparatus of claim 7 wherein:

said at least major part of said combined stream partially cools within said cooling stage so that said at least major part of said combined stream comprises said liquid and said vapor between said cooling and distillation stages; and said heavy impurity concentration means comprise a phase separator connected to said cooling stage and said distillation stage so that said at least major part of said combined stream separates in said phase separator into said liquid and said vapor and said vapor flows into said distillation stage.

9. The apparatus of claim 8, wherein:

said distillation stage is configured such that a liquid product stream is produced;

said cryogenic rectification means also include:

a pump connected between said distillation and cooling stages so that said liquid product stream is pumped to an elevated pressure and is thereafter vaporized within said cooling stage to produce said product stream at said elevated pressure;

booster compression means for subjecting a minor part of said combined stream to boosted compression so that a minor subsidiary stream is produced having a boosted pressure and said at least a major part of said combined stream comprises a major subsidiary stream;

said cooling stage connected to said booster compression means so that said minor subsidiary stream flows into said cooling stage in a direction countercurrent to that of said liquid product stream;

said distillation stage connected to said cooling stage so that said minor subsidiary stream flows into said distillation stage after said cooling stage; and said boosted pressure of said minor subsidiary stream being a sufficiently high pressure that said liquid product stream will be vaporized against a cooling of said subsidiary stream within said cooling stage.

10. The apparatus of claim 9, wherein:

said gaseous mixture comprises air and said higher and lower volatility components comprise nitrogen and oxygen, respectively, and said heavy impurities include carbon dioxide and hydrocarbons;

said distillation stage comprises a double column air separation unit having a higher pressure column connected to a lower pressure column in a heat transfer relationship;

said phase separator comprises an extended bottom portion of said higher pressure column;

said cooling and distillation stages are connected so that said vapor and said minor subsidiary stream flow into said double column air separation unit and the air is refined into oxygen-rich and nitrogen-rich fractions within said higher pressure column, said higher and lower pressure columns also connected so that an oxygen rich stream composed of said oxygen-rich fraction is discharged from said higher pressure column above said extended bottom portion and flows into said lower pressure column for further refinement, thereby to produce a liquid oxygen fraction and a nitrogen fraction; and said pump is connected to said lower pressure column so that said liquid product stream comprises said liquid oxygen fraction.

11. The apparatus of claim 7, wherein:

said distillation stage produces a descending liquid formed from a descending liquid phase; and said heavy impurity concentration means comprise liquid-vapor contacting elements configured to receive said descending liquid and to receive said at least major part of said combined stream as a vapor and thereby form an ascending phase intimately contacted with said descending liquid within said contacting elements so that said at least major part of said combined stream is scrubbed by said descending liquid to produce said liquid used in forming said recycle stream.

12. The apparatus of claim 11, wherein:

said distillation stage is configured such that a liquid product stream is produced;

said cryogenic rectification means also include:

a pump connected between said distillation and cooling stages so that said liquid product stream is pumped to an elevated pressure and is thereafter vaporized within said cooling stage to produce said product stream at said elevated pressure;

booster compression means for subjecting a minor part of said combined stream to boosted compression so that a minor subsidiary stream is produced having a boosted pressure and said at least a major part of said combined stream comprises a major subsidiary stream;

said cooling stage connected to said booster compression means so that said minor subsidiary stream flows into said cooling stage in a direction countercurrent to that of said liquid product stream;

said distillation stage connected to said cooling stage so that said minor subsidiary stream flows into said distillation stage after said cooling stage; and said boosted pressure of said minor subsidiary stream being a sufficiently high pressure that said liquid product stream will be vaporized against a cooling of said subsidiary stream within said cooling stage.

13. The apparatus of claim 12, wherein:

said gaseous mixture comprises air and said higher and lower volatility components comprise nitrogen and oxygen, respectively, and said heavy impurities include carbon dioxide and hydrocarbons;

said distillation stage comprises a double column air separation unit having a higher pressure column connected to a lower pressure column in a heat transfer relationship;

said phase separator comprises an extended bottom portion of said higher pressure column;

said cooling and distillation stages are connected so that said vapor and said minor subsidiary stream flow into said double column air separation unit and the air is refined into oxygen-rich and nitrogen-rich fractions within said higher pressure column, said higher and lower pressure columns also connected so that an oxygen rich stream composed of said oxygen-rich fraction is discharged from said higher pressure column above said extended bottom portion and flows into said lower pressure column for further refinement, thereby to produce a liquid oxygen fraction and a nitrogen fraction; and said pump is connected to said lower pressure column so that said liquid product stream comprises said liquid oxygen fraction.

14. The apparatus of claim 13 wherein:

said compression stage comprises a main compressor and a first aftercooler; and said booster compression means comprise a booster compressor and a second aftercooler.

* * * * *